US010656574B1

(12) United States Patent
Watanabe et al.

(10) Patent No.: US 10,656,574 B1
(45) Date of Patent: May 19, 2020

(54) IMAGE FORMING APPARATUS AND IMAGE FORMING METHOD

(71) Applicant: TOSHIBA TEC KABUSHIKI KAISHA, Shinagawa-ku, Tokyo (JP)

(72) Inventors: Takaho Watanabe, Mishima Shizuoka (JP); Hiroshi Ishii, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/285,280

(22) Filed: Feb. 26, 2019

(51) Int. Cl.
*G03G 15/20* (2006.01)
*G03G 21/20* (2006.01)

(52) U.S. Cl.
CPC ..... *G03G 15/2039* (2013.01); *G03G 15/2017* (2013.01); *G03G 15/2064* (2013.01); *G03G 21/206* (2013.01)

(58) Field of Classification Search
CPC ..... G03G 15/2039; G03G 15/2017; G03G 15/2064; G03G 21/206
See application file for complete search history.

(56) References Cited

U.S. PATENT DOCUMENTS 8,306,446 B2 * 11/2012 Ito ..... G03G 15/2039 399/329
8,805,224 B2 8/2014 Imamiya
2015/0277305 A1 * 10/2015 Umetsu ..... B41M 7/0009 399/69

* cited by examiner

*Primary Examiner* — Sandra Brase
(74) *Attorney, Agent, or Firm* — Amin, Turocy & Watson LLP

(57) ABSTRACT

According to one embodiment, an image forming apparatus includes a fixing member, a pressurizing member, a movable member, and a controller. The fixing member heats a sheet. The pressurizing member has first heat capacity and faces the fixing member. The movable member is provided to be movable between a contact position to contact with the pressurizing member and a separation position to be separated from the pressurizing member, and has second heat capacity smaller than the first heat capacity. The controller is configured to move the movable member to one of the contact position and the separation position based on a change of a control temperature of the fixing member or the pressurizing member.

23 Claims, 7 Drawing Sheets

IMAGE FORMING APPARATUS AND IMAGE FORMING METHOD

FIELD

Embodiments described herein relate generally to an image forming apparatus and an image forming method.

BACKGROUND

A fixing device has a problem that a variation of a temperature of a heating member is large when heat capacity of the heating member is small. Therefore, there is a fixing device configured to prevent the variation of the temperature of the fixing device by using a pressurizing member having large heat capacity. However, when the heat capacity of the pressurizing member is large, warm-up takes time. Also, there is a multifunction printer or the like having a plurality of modes, in which a heating temperature of the heating member is different. For example, there is a multifunction printer using decolorizing toner. Such a multifunction printer switches the temperature of the heating member between a first temperature at which the decolorizing toner is fixed and another temperature at which the decolorizing toner is decolorized at a temperature higher than the fixing temperature. When the heat capacity of the pressurizing member is increased in such a multifunction printer, it takes time for the temperature to decrease from the decolorizing temperature to the fixing temperature, and thus the switching undesirably takes too much time.

DETAILED DESCRIPTION

In general, according to one embodiment, an image forming apparatus includes a fixing member, a pressurizing member, a movable member, and a controller. The fixing member heats a sheet. The pressurizing member has first heat capacity and faces the fixing member. The movable member is provided to be movable between a contact position to contact with the pressurizing member and a separation position to be separated from the pressurizing member, and has second heat capacity smaller than the first heat capacity. The controller is configured to move the movable member to one of the contact position and the separation position based on a change of a control temperature of the fixing member or the pressurizing member.

Hereinafter, an image forming apparatus and an image forming method of embodiments will described with reference to drawings.

Figure 1:
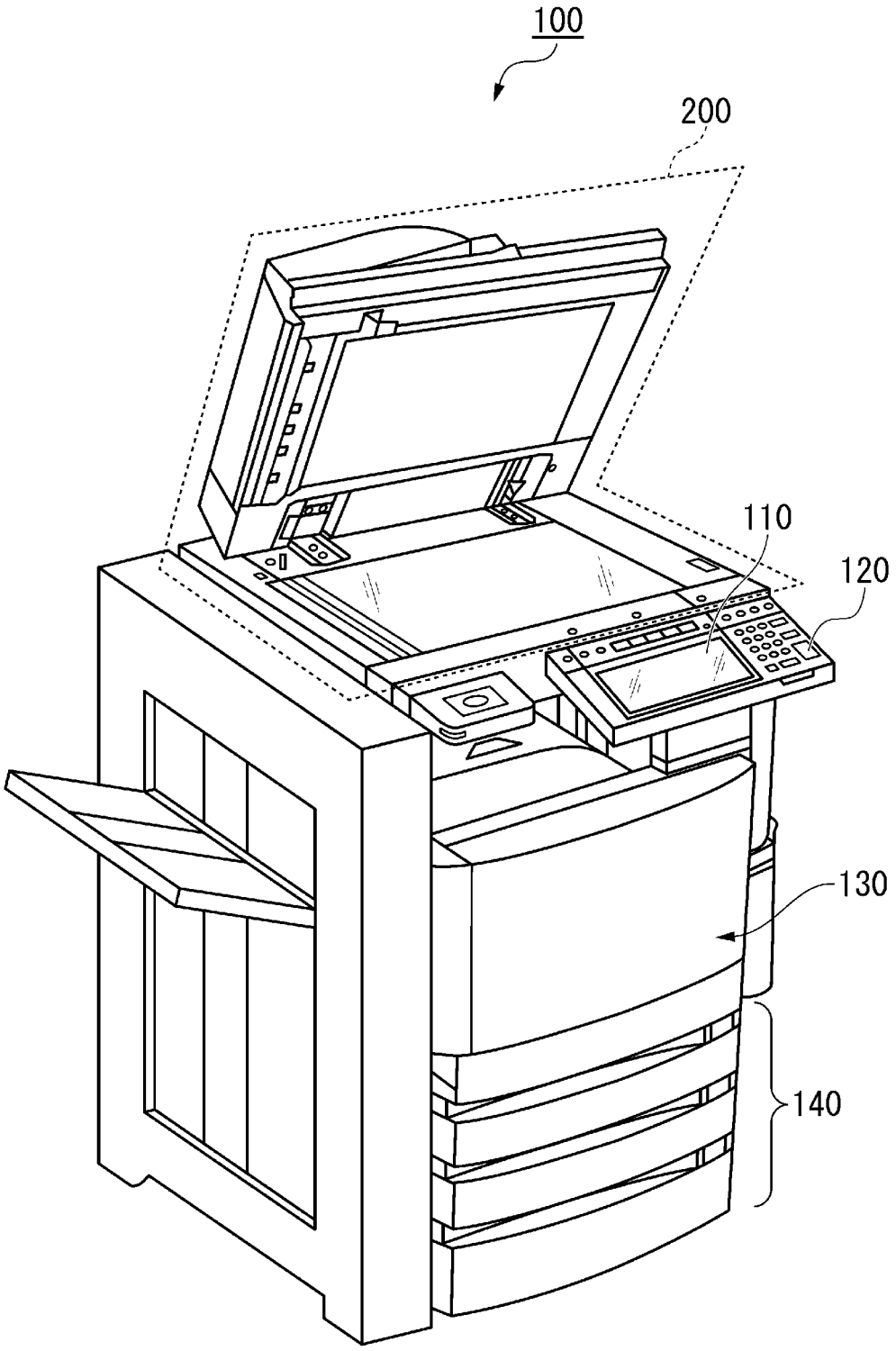
FIG. 1 is an external view illustrating an overall configuration example of an image forming apparatus according to an embodiment.

FIG. 1 is an external view illustrating an overall configuration example of an image forming apparatus 100 according to an embodiment. The image forming apparatus 100 is, for example, a multifunction printer. The image forming apparatus 100 includes a display 110, a control panel 120, a printer 130, a sheet accommodating unit 140, and an image reading unit 200. The printer 130 of the image forming apparatus 100 is an electrophotographic apparatus for fixing a toner image.

The image forming apparatus 100 forms an image on a sheet by using a developer such as toner. The sheet is, for example, a paper or a label paper. The sheet may be anything as long as the image forming apparatus 100 is able to form an image on a surface thereof.

The display 110 is an image display apparatus, such as a liquid crystal display or an organic electro luminescence (EL) display. The display 110 displays various types of information related to the image forming apparatus 100.

The control panel 120 includes a plurality of buttons. The control panel 120 receives an operation of a user. The control panel 120 outputs a signal to a controller of the image forming apparatus 100 based on an operation performed by the user. For example, the control panel 120 receives an instruction of an operation of the image forming apparatus 100 from the user. The display 110 and the control panel 120 may be configured as an integrated touch panel.

The printer 130 forms an image on the sheet based on image information generated by the image reading unit 200 or image information received via a communication path. The printer 130 forms an image according to, for example, following processes. An image forming unit of the printer 130 forms an electrostatic latent image on a photoconductive drum based on image information. The image forming unit of the printer 130 forms a visible image by attaching a developer to the electrostatic latent image. A specific example of the developer is toner.

Examples of the toner include decolorizing toner, non-decolorizing toner (general toner), decorative toner, etc. The decolorizing toner is decolorized by external stimulation. "Decolorization" denotes that an image formed in colors (including not only chromatic colors but also achromatic colors such as white and black) different from a base color of a paper is made to be visually invisible. For example, the external stimulation is a temperature, a light of a specific wavelength, and pressure. In the present embodiment, the decolorizing toner is decolorized when a temperature is equal to or higher than a specific decolorizing temperature. The decolorizing toner shows colors when the temperature is lower than or equal to a specific restoration temperature after decolorization.

Any type of toner may be used as the decolorizing toner as long as the toner has the characteristics described above. For example, a coloring agent of the decolorizing toner may be a leuco dye. The decolorizing toner may be appropriately combined with a developer, a decolorizer, a discoloration temperature adjuster, and the like.

A transfer unit of the printer 130 transfers the visible image onto the sheet. A fixing device 50 of the printer 130 fixes the visible image onto the sheet by applying heat and pressure to the sheet. The sheet on which the image is formed may be a sheet accommodated in the sheet accommodating unit 140 or may be a sheet that is manually fed. The fixing device 50 of the printer 130 will be described by using FIGS. 2 to 5.

The sheet accommodating unit 140 accommodates a sheet used for image formation of the printer 130.

The image reading unit 200 reads image information that is reading target via contrast of light. The image reading unit 200 records the read image information. The recorded image information may be transmitted to another information processing apparatus via a network. The recorded image information is formed as an image on the sheet by the printer 130. The image reading unit 200 may include an ADF.

Figure 2:
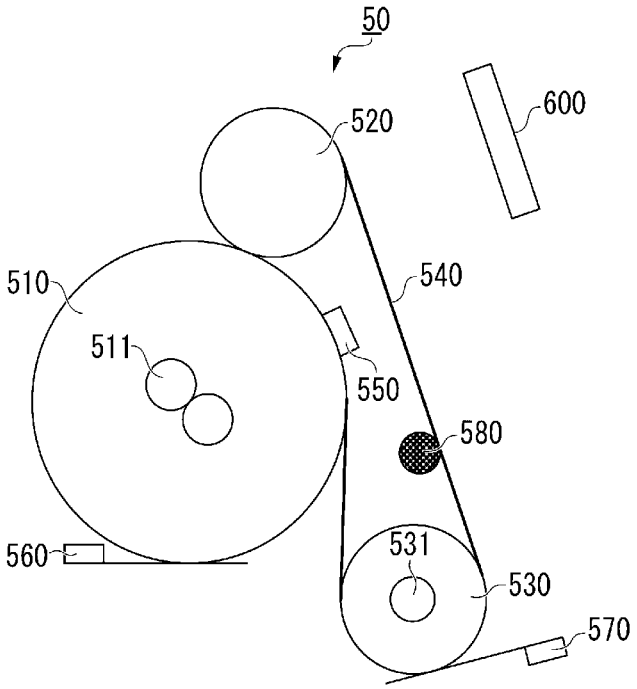
FIG. 2 is a schematic diagram illustrating a configuration example of a printing unit of a fixing device provided in a printer.
Figure 3:
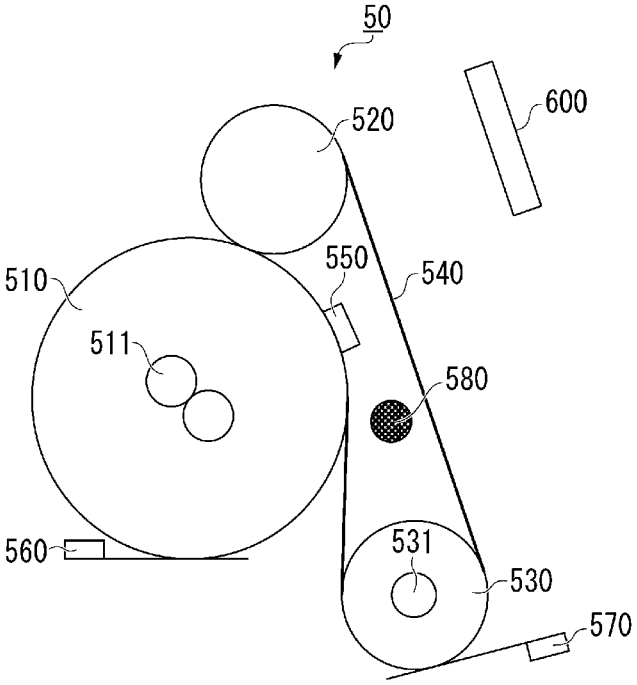
FIG. 3 is a schematic diagram illustrating a configuration example of the fixing device provided in the printer.

FIGS. 2 to 3 are schematic diagrams illustrating configuration examples of a printing unit of the fixing device 50 provided in the printer 130.

The fixing device 50 includes a fixing roller 510, a pressurizing roller 520, a pressurizing side heat roller 530, a pressurizing belt 540, a pressurizing pad 550, a fixing side thermistor 560, a pressurizing side thermistor 570, a movable member 580, and a cooling device 600.

The fixing roller 510 is a fixing member formed in a cylindrical shape. The fixing roller 510 heats the sheet for fixation or decolorization of a developer transferred to the sheet. For example, the fixing roller 510 includes a fixing side HR lamp 511 (heater) therein. The fixing side HR lamp 511 generates heat to heat the fixing roller 510. The fixing roller 510 forms a fixing nip of a predetermined width with the pressurizing roller 520 by contacting the pressuring belt 540.

The pressurizing roller 520 pressurizes the pressurizing belt 540 to bring the pressurizing belt 540 into pressure contact with the fixing roller 510. An outlet of the fixing nip is formed by the pressurizing roller 520.

The pressurizing side heat roller 530 heats the pressurizing belt 540. The pressurizing side heat roller 530 includes a pressurizing side HR lamp (pressurizing side heating member: heater) 531. The pressurizing side HR lamp 531 generates heat to heat the pressurizing side heat roller 530. The pressurizing side HR lamp 531 is configured by using, for example, a halogen lamp.

The pressurizing belt 540 is retained by the pressurizing roller 520 and the pressurizing side heat roller 530. The pressurizing belt 540 is pressurized and brought into pressure contact with the fixing roller 510 by the pressurizing pad 550, the pressurizing roller 520, and the pressurizing side heat roller 530. According to such pressure contact, a fixing nip is formed between the pressurizing belt 540 and the fixing roller 510.

The pressurizing pad 550 pressurizes the pressurizing belt 540 to be brought into pressure contact with the fixing roller 510.

The fixing side thermistor 560 measures a surface temperature of the fixing roller 510. The surface temperature of the fixing roller 510 measured by the fixing side thermistor 560 is almost the same as a temperature of the fixing nip described later. In the present embodiment, the temperature of the fixing device 50 will be a temperature measured on the fixing roller 510 (hereinafter, referred to as a "measured temperature"). However, the temperature of the fixing device 50 may be obtained via any measuring method as long as the temperature reflects the temperature of the fixing nip.

The pressurizing side thermistor 570 measures a surface temperature of the pressurizing side heat roller 530.

The movable member 580 is movable between a position contacting a pressurizing member (hereinafter, referred to as a "contact position") and a position separated from the pressurizing member (hereinafter, referred to as a "separation position"). The pressurizing member is the pressurizing roller 520, the pressurizing side heat roller 530, and the pressurizing belt 540. When a variation of temperature of the pressurizing member is reduced, a controller 160 moves the movable member 580 to the contact position. When the pressurizing member is heated or cooled to a target temperature, the controller 160 moves the movable member 580 to the separation position.

The movable member 580 includes a metal roller or the like made of aluminum, iron, nickel, copper, or the like. When a configuration at the pressurizing member side as described above is considered while excluding the movable member 580, the movable member 580 has heat capacity (second heat capacity) lower than heat capacity (first heat capacity) of the pressurizing member. In particular, since heat capacity of the pressurizing roller 520 is easily increased due to a metal core portion thereof, the metal core portion of the pressurizing roller 520 may be adjusted to have suitable heat capacity, and at the same time, the heat capacity of the movable member 580 may be set to be smaller than the heat capacity of the pressurizing roller 520 such that the heat capacity of overall pressurizing member is not excessively increased. As a material of the movable member 580, a material that is easily warmed via radiation heat or the like by the pressuring side heat roller 530 is preferable.

The cooling device 600 cools the fixing device 50. For example, the cooling device 600 is a fan. During cooling, the image forming apparatus 100 cools the fixing device 50 by using the cooling device 600. When the cooling is performed by using the cooling device 600, cooling efficiency may be increased by rotating the pressurizing belt 540 at a high speed.

The fixing device 50 above is an example, and the present embodiment needs to include at least the fixing roller 510, the pressurizing roller 520, the pressurizing belt 540, and the movable member 580.

Figure 4:
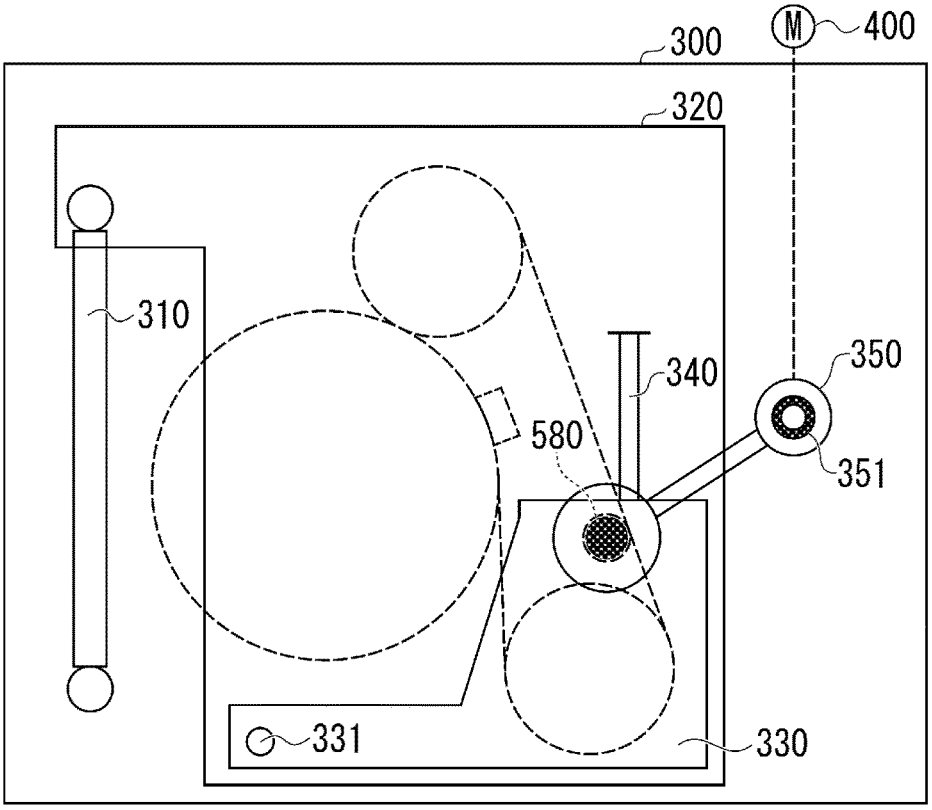
FIG. 4 is a schematic diagram illustrating a configuration example of a component for operating a movable member.
Figure 5:
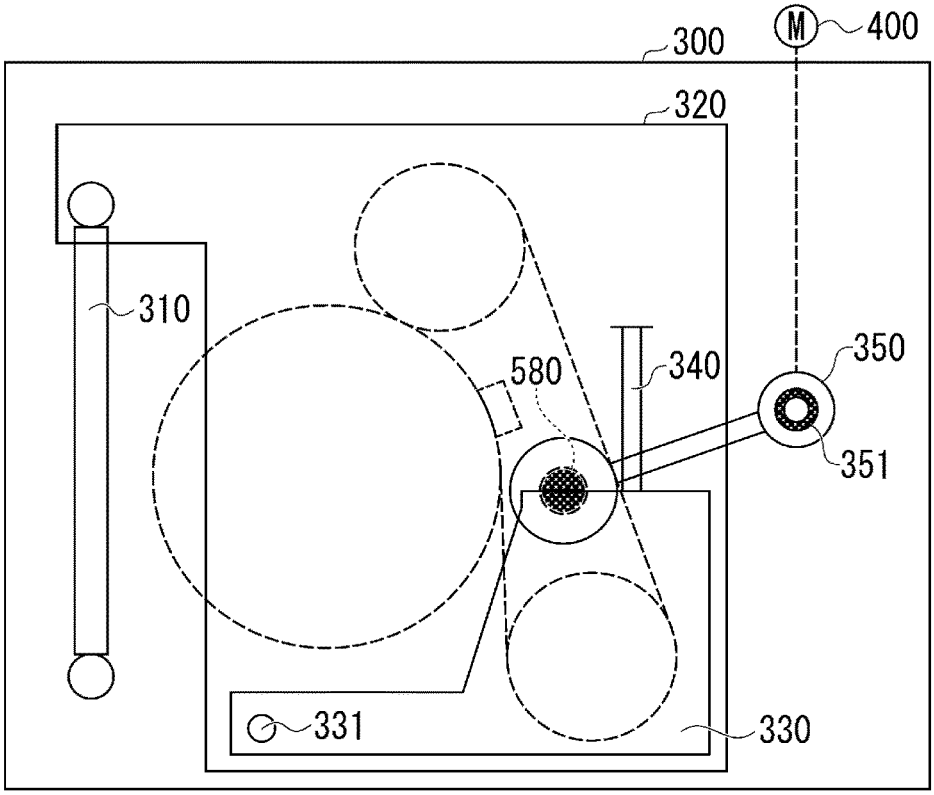
FIG. 5 is a schematic view illustrating a configuration example of a component for operating the movable member.

FIGS. 4 and 5 are schematic diagrams illustrating configuration examples of a component for operating the movable member 580 according to the embodiment. The image forming apparatus 100 includes a fixing device frame 300 and an external arm control device 400.

The fixing device frame 300 includes a pressurizing spring 310, a pressurizing arm 320, a belt tension arm 330, a belt tension spring 340, and a movable member arm 350.

The pressurizing spring 310 presses the pressurizing roller 520 against the fixing roller 510.

The pressurizing arm 320 supports the pressurizing roller 520.

The belt tension arm 330 is fixed to the pressurizing arm 320 by a shaft 331 of one point, and rotates around the shaft 331.

The belt tension spring 340 provides tension to the pressurizing belt 540.

The movable member arm 350 retains the movable member 580. The movable member arm 350 rotates around a fulcrum 351.

The external arm control device 400 controls the movable member arm 350. For example, the external arm control device 400 is a motor. The movable member arm 350 rotates in conjunction as the external arm control device 400 rotates.

In FIGS. 4 and 5, the movable member arm 350 rotates around the fulcrum 351. Accordingly, the movable member arm 350 may cause the movable member 580 to contact the pressurizing belt 540. The movable member arm 350 may cause the movable member 580 to be separated from the pressurizing belt 540.

Figure 6:
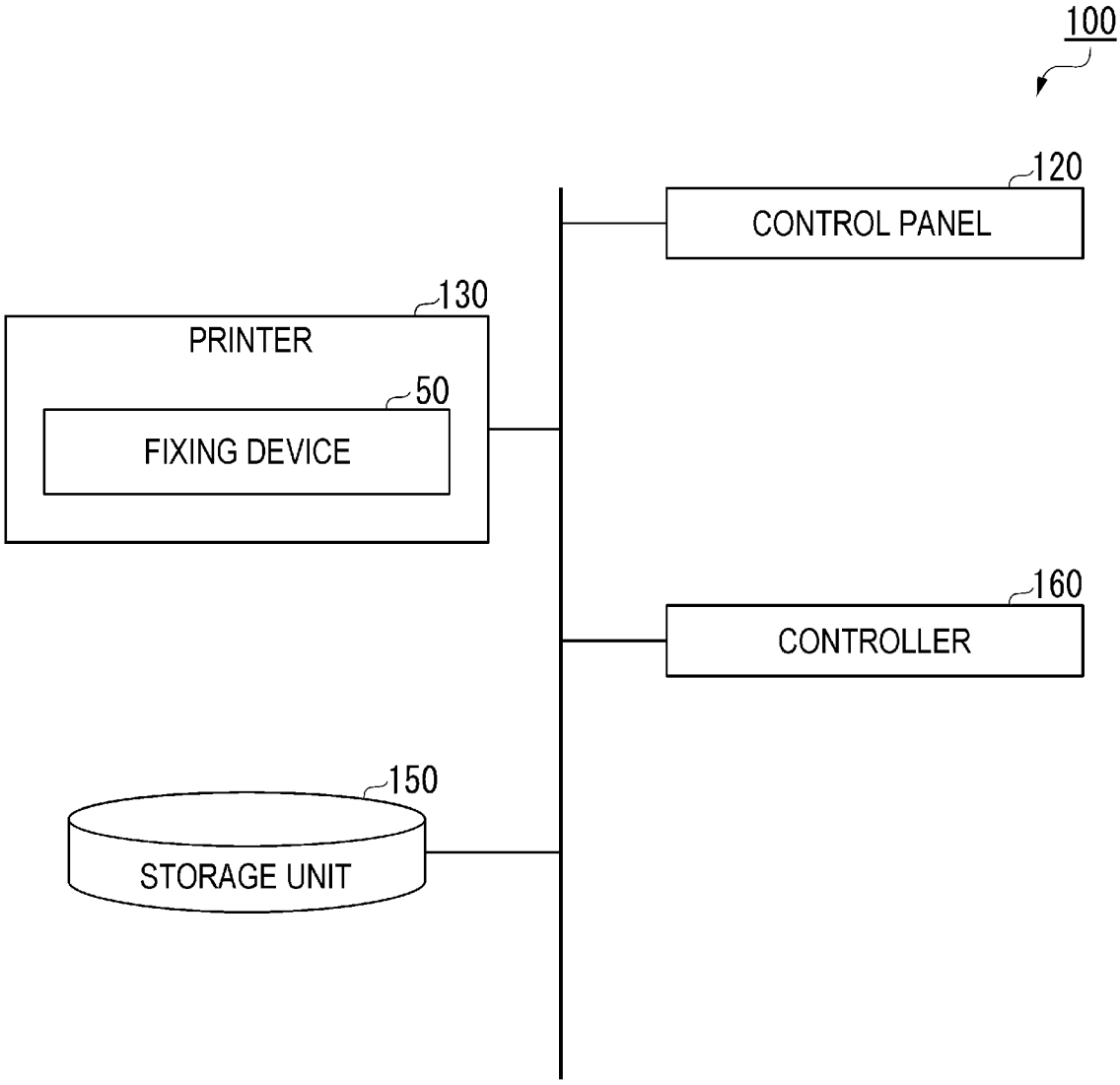
FIG. 6 is a block diagram illustrating functions of the image forming apparatus.

FIG. 6 is a block diagram illustrating functions of the image forming apparatus 100 according to the embodiment. The image forming apparatus 100 includes the control panel 120, the printer 130, a storage unit 150, and the controller 160. Here, descriptions about the control panel 120 and the printer 130 already described with reference to FIGS. 1 to 5 will be omitted.

The storage unit 150 is configured by using a storage device, such as a magnetic hard disk device, a semiconductor storage device, or the like. The storage unit 150 stores in advance a program for causing the image forming apparatus 100 to execute an operating mode. The operating mode is an operation set in advance in the image forming apparatus 100, such as normal printing, decolorizing printing, and decolorization. Hereinafter, normal printing may be referred to as a normal printing mode, decolorizing printing may be referred to as a decolorizing printing mode, and decolorization may be referred to as a decolorizing mode. The storage unit 150 may store information other than above, for example, temperatures of the fixing side thermistor 560 and pressurizing side thermistor 570.

The controller 160 is configured by using a processor, such as a central processing unit (CPU).

The controller 160 controls a position of the movable member 580. The controller 160 obtains a measured temperature from the fixing side thermistor 560. Then, the controller 160 obtains the position of the movable member 580. For example, the controller 160 may obtain the position of the movable member 580 based on a control state of the movable member arm 350. For example, the controller 160 may estimate the position of the movable member 580 based on a state of a motor of the movable member arm 350.

For example, the controller 160 may estimate the position of the movable member 580 based on an output of an optical sensor. The controller 160 determines whether the movable member 580 is in contact with the pressurizing member based on the obtained position of the movable member 580.

The controller 160 determines whether the measured temperature is within an optimal temperature range corresponding to the operating mode based on the selected operating mode, the measured temperature, or the like. The optimal temperature range is indicated by two threshold values (hereinafter, referred to as "temperature threshold values") of an upper limit temperature indicating an upper limit of an optimal temperature and a lower limit temperature indicating a lower limit of the optimal temperature. The optimal temperature range is set in advance according to each operating mode. The controller 160 controls the movable member 580 to be in one of the contact position and the separation position based on a determination result.

The controller 160 controls the cooling device 600. For example, when the measured temperature is higher than the upper limit temperature, the controller 160 operates the cooling device 600 to cool the fixing device 50.

The controller 160 determines whether the image forming apparatus 100 satisfies a predetermined condition (contact condition, separation condition). The predetermined condition is a condition related to a temperature change of the fixing roller 510. For example, the predetermined condition is a condition indicating whether the number of printed sheets is equal to or greater than a predetermined number of sheets. In this case, the controller 160 determines whether the number of printed sheets exceeds the predetermined number of sheets.

For example, the predetermined condition is a condition indicating whether a printing time exceeds a predetermined time. The controller 160 determines whether the printing time exceeds the predetermined time. For example, the predetermined condition is a condition indicating whether the measured temperature is within a predetermined optimal temperature range corresponding to each operating mode (the decolorizing mode, the decolorizing printing mode, and the normal printing mode). In this case, the controller 160 determines whether the measured temperature is within the predetermined optimal temperature range.

The controller 160 controls the position of the movable member 580 based on the determination result of the controller 160. When the predetermined contact condition is satisfied, the controller 160 controls the movable member 580 to be in the contact position. When the predetermined separation condition is satisfied, the controller 160 controls the movable member 580 to be in the separation position. When either of the contact condition and the separation condition is not satisfied, the controller 160 controls the movable member 580 to be as it is without moving.

Figure 7:
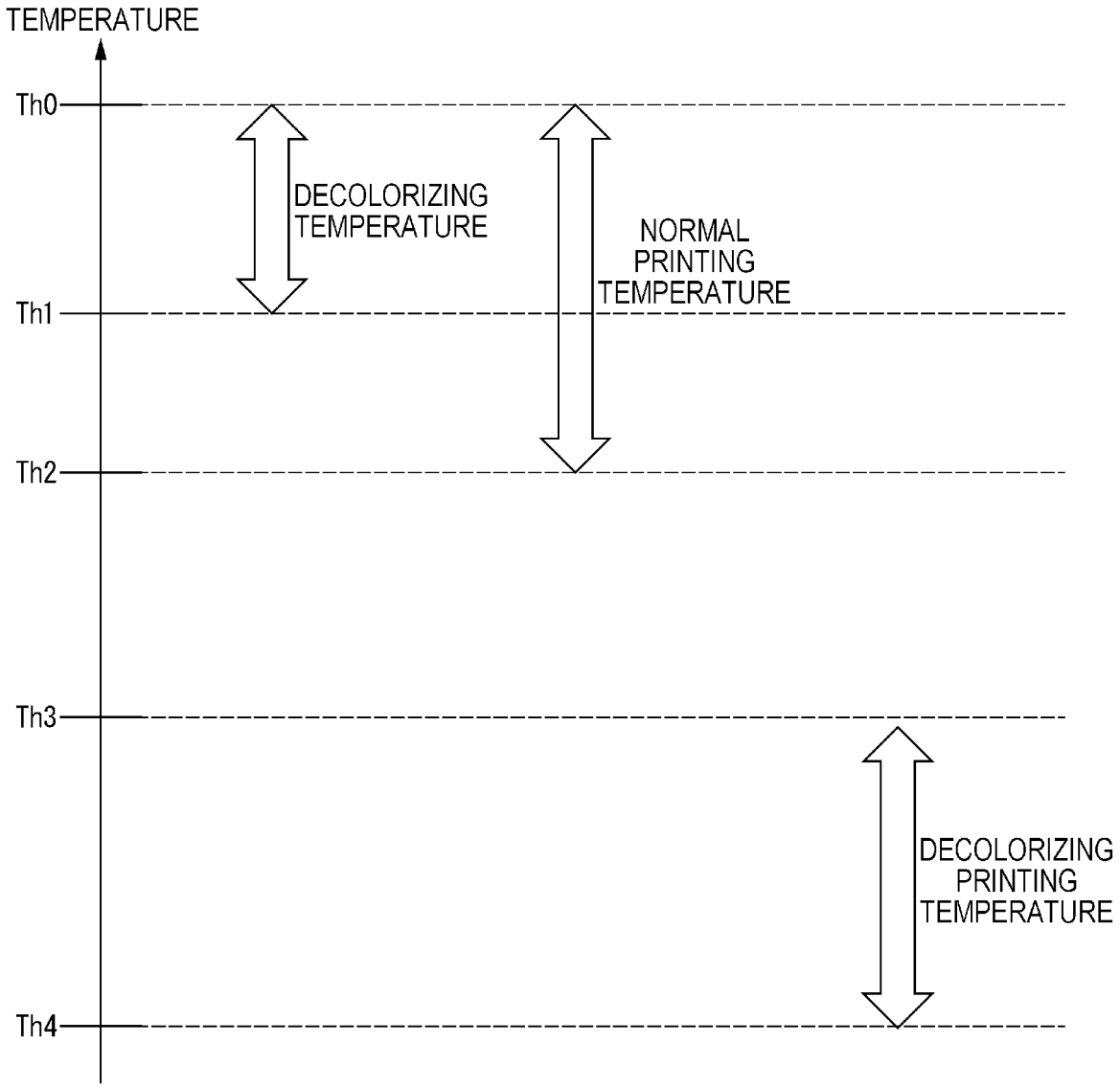
FIG. 7 is a diagram illustrating a specific example of a temperature threshold value of each operating mode.

FIG. 7 is a diagram illustrating a specific example of a temperature threshold value of each operating mode according to the embodiment. FIG. 7 illustrates, as examples of operating modes of the present embodiment, temperature threshold values Th0 to Th4 for decolorizing printing, normal printing, and decolorizing. Hereinafter, a temperature threshold value in each operating mode will be described.

In FIG. 7, for example, the temperature threshold value Th0 is an upper limit temperature set in advance to operate the image forming apparatus 100 as the decolorizing mode or the normal printing mode. For example, the temperature threshold value Th1 is a lower limit temperature set in advance to operate the image forming apparatus 100 as the decolorizing mode. For example, the temperature threshold value Th1 is about 130° C. For example, the temperature threshold value Th2 is a lower limit temperature set in advance to operate the image forming apparatus 100 as the normal printing mode. For example, the temperature threshold value Th2 is about 120° C.

For example, the temperature threshold value Th3 is an upper limit temperature set in advance to operate the image forming apparatus 100 as the decolorizing printing mode. For example, the temperature threshold value Th3 is about 100° C. For example, the temperature threshold value Th4 is a lower limit temperature set in advance to operate the image forming apparatus 100 as the decolorizing printing mode. For example, the temperature threshold value Th4 is about 95° C.

Next, operations at each timing will be described.

Warm-Up or Sleep Return

In warm-up or sleep return, the current temperature of the fixing device 50 is increased or decreased to a temperature (optimal temperature) necessary for a default designated mode or an operating mode designated by a user.

The default designated mode is generally a decolorizing toner printing mode, and at this time, a pressurizing side setting temperature is 90° C.

When the operating mode designated by the user is the decolorizing mode, the pressurizing side setting temperature is 130° C. Directly after power is turned on or when a sleep time was long, since a contacting member is generally in a state below a temperature necessary for each mode, the fixing device 50 is heated while the movable member 580 is in a separated state.

When Standing by for Cooling

On the other hand, when the decolorizing toner printing mode is designated after the decolorizing mode ended or when the decolorizing toner printing mode is designated after a non-decolorizing toner printing mode, the contacting member is separated and cooled until the pressurizing side setting temperature is lower than or equal to 90° C.

When Decolorizing

When the above warm-up operation or standing by for cooling is completed, execution of the decolorizing mode starts. After the decolorizing mode starts, when the number of decolorized sheets reaches a certain value and the temperature of the pressurizing member is stabilized, the movable member 580 is contacted and the decolorizing mode is continued.

Normal Printing, Decolorizing Printing

When the above warm-up operation or standing by for cooling is completed and the operating mode selected by the user is normal printing, the controller 160 starts normal printing. If the decolorizing printing mode is selected by the user, the controller 160 starts decolorizing printing.

Next, when a predetermined condition in which the temperature is stabilized (for example, a lapse of predetermined time) is satisfied, the controller 160 moves the movable member 580 to the contact position.

Figure 8:
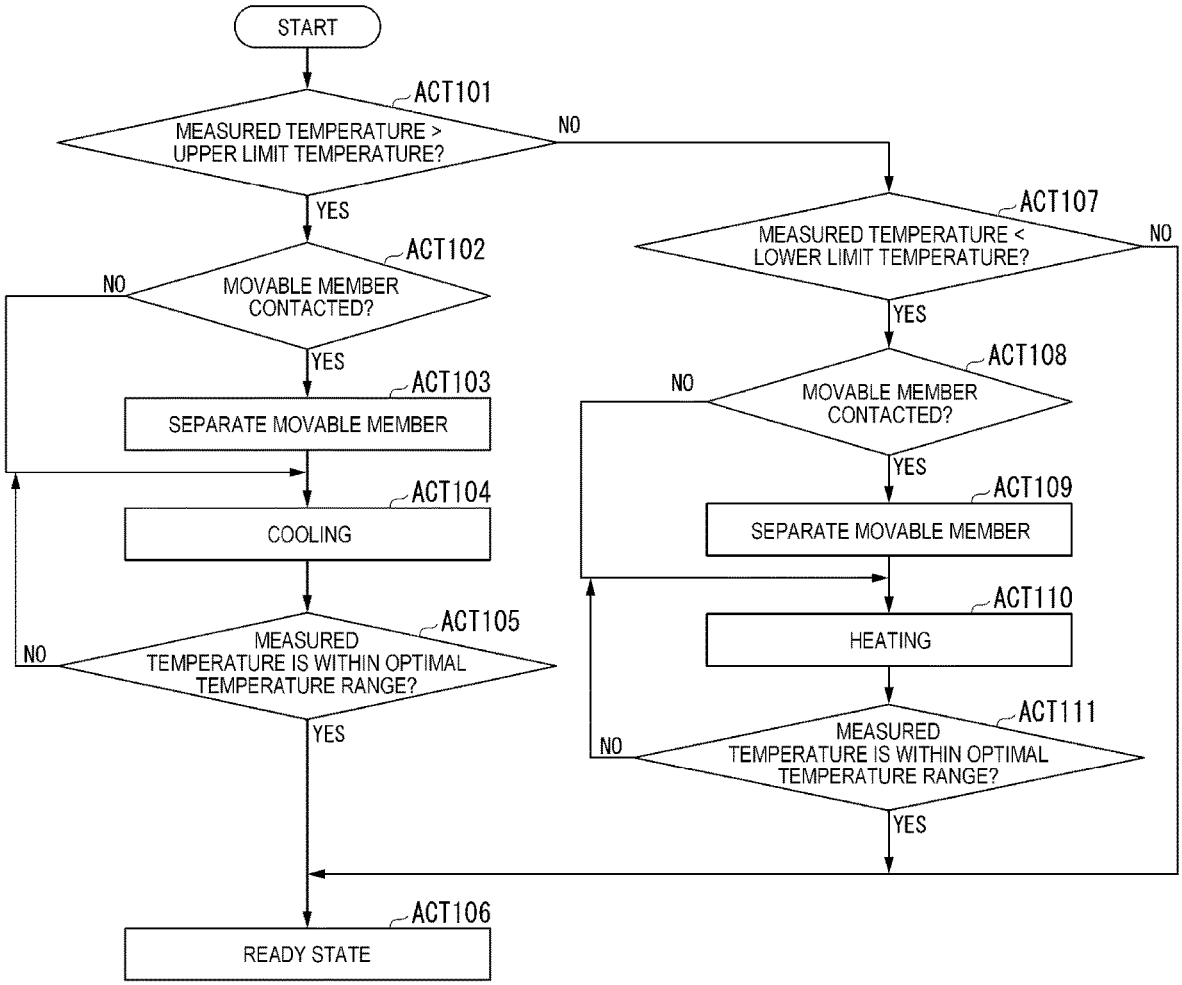
FIG. 8 is a flowchart illustrating a specific example of a flow of operations when the image forming apparatus is not in a ready state.

FIG. 8 is a flowchart illustrating a specific example of a flow of operations for the image forming apparatus 100 to become a ready state. For example, the operations illustrated in FIG. 8 are performed during a warm-up time, a state directly after returning from sleep, or the like.

The controller 160 determines an operating mode. The operating mode may be determined based on, for example, an instruction of the operating mode from the user of the control panel 120. The operating mode may be determined based on, for example, a control signal (for example, a print instruction) from an information processing apparatus operated by the user. The controller 160 obtains values of the optimal temperature range (the upper limit temperature and the lower limit temperature) corresponding to the operating mode, based on a table set in advance therein.

The controller 160 determines whether the measured temperature exceeds the upper limit temperature of the optimal temperature range corresponding to the operating mode (ACT 101). When the measured temperature is higher than the upper limit temperature (YES in ACT 101), the controller 160 determines whether the movable member 580 is in the contact position (ACT 102). When the movable member 580 is in the contact position (YES in ACT 102), the controller 160 moves the position of the movable member 580 to the separation position (ACT 103). On the other hand, when the movable member 580 is not in the contact position (NO in ACT 102), the controller 160 performs a following process (ACT 104) without changing the position of the movable member 580.

Next, the controller 160 operates the cooling device 600 to cool the fixing device 50 (ACT 104). Then, the controller 160 determines whether the measured temperature is within the optimal temperature range corresponding to the operating mode (ACT 105). The controller 160 continues cooling until the measured temperature reaches the optimal temperature range corresponding to the operating mode. When the measured temperature is within the optimal temperature range corresponding to the operating mode, the controller 160 converts to a ready state (ACT 106).

In the process of ACT 101, when the measured temperature is lower than the upper limit temperature (NO in ACT 101), the controller 160 performs a process of ACT 107. The controller 160 determines whether the measured temperature exceeds the lower limit temperature of the optimal temperature range corresponding to the operating mode (ACT 107). When the measured temperature is lower than the lower limit temperature (YES in ACT 107), the controller 160 determines whether the movable member 580 is in the contact position (ACT 108). When the movable member 580 is in the contact position (YES in ACT 108), the controller 160 moves the position of the movable member 580 to the separation position (ACT 109). On the other hand, when the movable member 580 is not in the contact position (NO in ACT 108), the controller 160 performs a following process (ACT 110) without changing the position of the movable member 580.

Next, the controller 160 causes the heater of the fixing device 50 to operate to heat the fixing device 50 (ACT 110). Then, the controller 160 determines whether the measured temperature is within the optimal temperature range corresponding to the operating mode (ACT 111). The controller 160 continues heating until the measured temperature is within the optimal temperature range corresponding to the operating mode. When the measured temperature is within the optimal temperature range corresponding to the operating mode, the controller 160 converts to the ready state (ACT 106).

Figure 9:
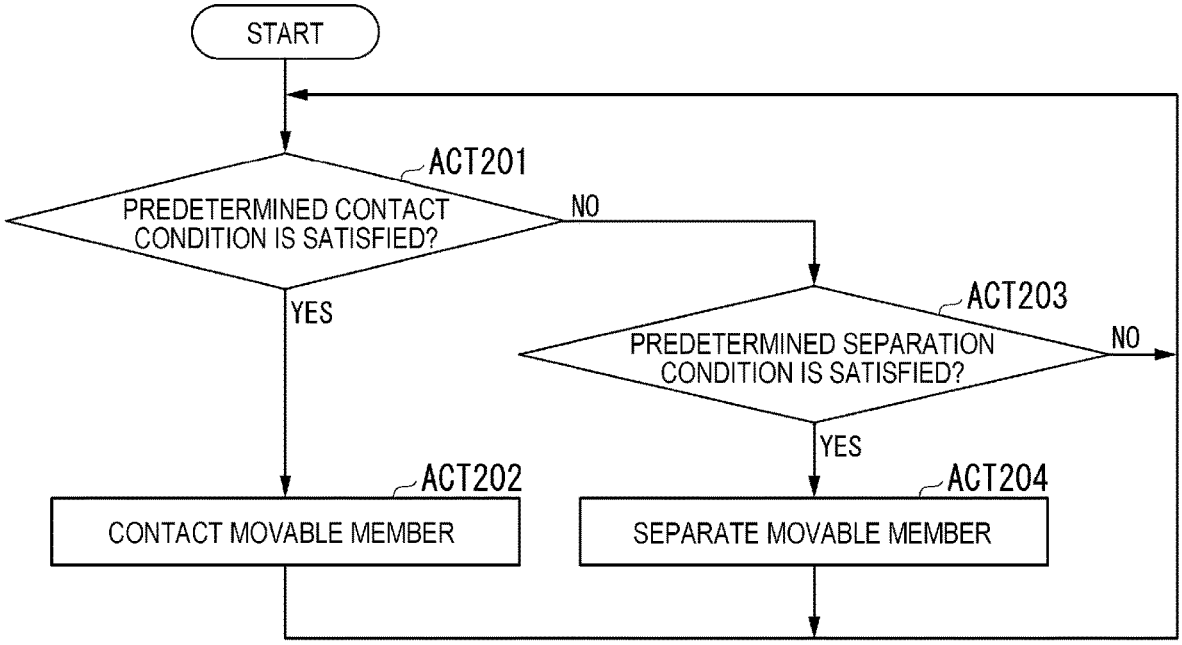
FIG. 9 is a flowchart illustrating a specific example of a flow of operations while the image forming apparatus operates in a predetermined operating mode after the ready state.

FIG. 9 is a flowchart illustrating a specific example of a flow of operations while the image forming apparatus 100 operates in a predetermined operating mode after a ready state. For example, the operations illustrated in FIG. 9 are performed during an operation in the decolorizing mode, during an operation in the decolorizing printing mode, or during an operation in the normal printing mode.

The controller 160 determines whether the predetermined contact condition is satisfied (ACT 201). When the predetermined contact condition is satisfied (YES in ACT 201), the controller 160 controls the position of the movable member 580 to the contact position (ACT 202). The controller 160 determines whether the predetermined separation condition is satisfied (ACT 203). When the predetermined separation condition is satisfied (YES in ACT 203), the controller 160 controls the position of the movable member 580 to the separation position (ACT 204). When either of the two conditions is not satisfied (NO in ACT 201 and NO in ACT 203), the controller 160 keeps the position of the movable member 580 as it is.

According to the image forming apparatus 100 of an embodiment configured as such, the movement of the movable member 580 may be controlled by including the movable member 580 and the controller 160. The controller 160 obtains the measured temperature and the temperature threshold value set in advance according to the operating mode. The controller 160 controls the contact position in which the movable member 580 contacts with the pressurizing member and the separation position in which the movable member 580 is separated from the pressurizing member, based on the measured temperature and the temperature threshold value. Accordingly, the temperature of the fixing device 50 of the image forming apparatus 100 including the fixing device 50 having low heat capacity may be easily adjusted.

For example, the controller 160 moves the movable member 580 to the separation position when the image forming apparatus 100 converts from a power saving state to a normal state. The power saving state is a state in which power consumption is lower than the normal state. After moving the movable member 580 to the separation position, the image forming apparatus 100 heats the fixing device 50.

This is because it takes time to heat the heat capacity of the pressurizing member and the movable member 580. By moving the movable member 580 to the separation position and heating the fixing device 50, the image forming apparatus 100 may reduce a heating time until a target temperature is reached.

Modified Example

In a fixing device of the present embodiment, a method of fixing a toner image on paper by heating the toner image via a film member may be applied.

A plurality of the movable members 580 may be provided in the fixing device 50. The controller 160 may control the plurality of movable members 580 based on the measured temperature and the temperature threshold value.

The controller 160 may heat the movable member 580. The controller 160 may cool the movable member 580.

The separation position may be a position close to the pressurizing side HR lamp 531 to such an extent that the movable member 580 is heated by the pressurizing side HR lamp 531. By such configuration, while the movable member 580 is positioned in the separation position, the movable member 580 may be heated by the pressurizing side HR lamp 531.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and their equivalents are intended to cover such forms or modifications as would fall within the scope and spirit of the invention.

What is claimed is:

1. An image forming apparatus, comprising:
a fixing member configured to heat a sheet;
a pressurizing member having a first heat capacity and facing the fixing member;
a movable member configured to be movable between a contact position to contact with the pressurizing member and a separation position separated from the pressurizing member, and having a second heat capacity smaller than the first heat capacity;
a controller configured to move the movable member to one of the contact position and the separation position based on a change of a control temperature of the fixing member or the pressurizing member; and
a cooling device for cooling the fixing member and the pressurizing member, wherein
the controller causes the cooling device to cool the fixing member and the pressurizing member based on a control result of the movable member, wherein
the controller is further configured to control the cooling device to cool the fixing member and the pressurizing member when the fixing member and the pressurizing member are not heated and when the movable member is moved to the separation position.

2. The apparatus according to claim 1, wherein
the controller is further configured to move the movable member to one of the contact position and the separation position based on whether a predetermined condition is satisfied.

3. The apparatus according to claim 2, wherein
the predetermined condition is a condition related to a temperature change of at least one of the fixing member and the pressurizing member, and is at least one condition among a condition indicating whether a number of printed sheets is equal to or greater than a predetermined number of sheets, a condition indicating whether a printing time exceeds a predetermined time, and a condition indicating whether at least one of a temperature of the fixing member and a temperature of the pressurizing member exceeds a predetermined temperature.

4. An image forming apparatus, comprising:
a fixing member configured to heat a sheet;
a pressurizing member having a first heat capacity and facing the fixing member;
a movable member configured to be movable between a contact position to contact with the pressurizing member and a separation position separated from the pressurizing member, and having a second heat capacity smaller than the first heat capacity; and
a controller configured to move the movable member to one of the contact position and the separation position based on a change of a control temperature of the fixing member or the pressurizing member, wherein
the controller is further configured to heat the fixing member and the pressurizing member when the movable member is moved to the contact position.

5. The apparatus according to claim 4, wherein
the controller is further configured to move the movable member to the separation position and heat the fixing member and the pressurizing member when the apparatus is activated.

6. The apparatus according to claim 5, further comprising:
a pressurizing side heating member for heating the pressurizing member, wherein
the controller is further configured to heat the pressurizing member by heating the pressurizing side heating member, and
the separation position is a position close to the pressurizing side heating member such that the movable member is heated by the pressurizing side heating member.

7. The apparatus according to claim 4, wherein
the controller is further configured to move the movable member to one of the contact position and the separation position based on whether a predetermined condition is satisfied.

8. The apparatus according to claim 7, wherein
the predetermined condition is a condition related to a temperature change of at least one of the fixing member and the pressurizing member, and is at least one condition among a condition indicating whether a number of printed sheets is equal to or greater than a predetermined number of sheets, a condition indicating whether a printing time exceeds a predetermined time, and a condition indicating whether at least one of a temperature of the fixing member and a temperature of the pressurizing member exceeds a predetermined temperature.

9. An image forming apparatus, comprising:
a fixing member configured to heat a sheet;
a pressurizing member having a first heat capacity and facing the fixing member;
a movable member configured to be movable between a contact position to contact with the pressurizing member and a separation position separated from the pressurizing member, and having a second heat capacity smaller than the first heat capacity; and a controller configured to move the movable member to one of the contact position and the separation position based on a change of a control temperature of the fixing member or the pressurizing member, the image forming apparatus having a first mode in which the fixing member heats the sheet at a first temperature and a second mode in which the fixing member heats the sheet at a second temperature lower than the first temperature, wherein the controller is further configured to move the movable member to the separation position when the fixing member needs to be cooled based on a change from the first mode to the second mode.

10. The apparatus of claim 9, wherein the first mode is one of a decolorizing mode and a normal printing mode, and the second mode is a decolorizing printing mode.

11. The apparatus according to claim 9, wherein the controller is further configured to move the movable member to one of the contact position and the separation position based on whether a predetermined condition is satisfied.

12. The apparatus according to claim 11, wherein the predetermined condition is a condition related to a temperature change of at least one of the fixing member and the pressurizing member, and is at least one condition among a condition indicating whether a number of printed sheets is equal to or greater than a predetermined number of sheets, a condition indicating whether a printing time exceeds a predetermined time, and a condition indicating whether at least one of a temperature of the fixing member and a temperature of the pressurizing member exceeds a predetermined temperature.

13. An image forming apparatus, comprising:

a fixing member configured to heat a sheet;

a pressurizing member having a first heat capacity and facing the fixing member;

a movable member configured to be movable between a contact position to contact with the pressurizing member and a separation position separated from the pressurizing member, and having a second heat capacity smaller than the first heat capacity; and a controller configured to move the movable member to one of the contact position and the separation position based on a change of a control temperature of the fixing member or the pressurizing member, the image forming apparatus having a first mode in which the fixing member heats the sheet at a first temperature and a second mode in which the fixing member heats the sheet at a second temperature lower than the first temperature, wherein the controller is further configured to move the movable member to the separation position when the fixing member needs to be heated based on a change from the second mode to the first mode.

14. The apparatus of claim 13, wherein the first mode is one of a decolorizing mode and a normal printing mode, and the second mode is a decolorizing printing mode.

15. The apparatus according to claim 13, wherein the controller is further configured to move the movable member to one of the contact position and the separation position based on whether a predetermined condition is satisfied.

16. The apparatus according to claim 15, wherein the predetermined condition is a condition related to a temperature change of at least one of the fixing member and the pressurizing member, and is at least one condition among a condition indicating whether a number of printed sheets is equal to or greater than a predetermined number of sheets, a condition indicating whether a printing time exceeds a predetermined time, and a condition indicating whether at least one of a temperature of the fixing member and a temperature of the pressurizing member exceeds a predetermined temperature.

17. A sheet processing method, comprising:

heating a sheet;

moving a movable member between a contact position to contact with a pressurizing member having a first heat capacity and a separation position separated from the pressurizing member based on a predetermined condition, and having a second heat capacity smaller than first heat capacity, to one of the contact position and the separation position based on a change of a control temperature of a fixing member or the pressurizing member;

cooling the fixing member and the pressurizing member, wherein a cooling device cools the fixing member and the pressurizing member based on a control result of the movable member; and cooling the fixing member and the pressurizing member when the fixing member and the pressurizing member are not heated and when the movable member is moved to the separation position.

18. The sheet processing method according to claim 17, further comprising:

moving the movable member to one of the contact position and the separation position based on whether a predetermined condition is satisfied.

19. The sheet processing method according to claim 18, wherein the predetermined condition is a condition related to a temperature change of at least one of the fixing member and the pressurizing member, and is at least one condition among a condition indicating whether a number of printed sheets is equal to or greater than a predetermined number of sheets, a condition indicating whether a printing time exceeds a predetermined time, and a condition indicating whether at least one of a temperature of the fixing member and a temperature of the pressurizing member exceeds a predetermined temperature.

20. A sheet processing method, comprising:

heating a sheet;

moving a movable member between a contact position to contact with a pressurizing member having a first heat capacity and a separation position separated from the pressurizing member based on a predetermined condition, and having a second heat capacity smaller than first heat capacity, to one of the contact position and the separation position based on a change of a control temperature of a fixing member or the pressurizing member; and heating the fixing member and the pressurizing member when the movable member is moved to the contact position.

21. The sheet processing method according to claim 20, further comprising:

moving the movable member to the separation position and heating the fixing member and the pressurizing member when an image forming apparatus is activated.

22. The sheet processing method according to claim 20, further comprising:

moving the movable member to one of the contact position and the separation position based on whether a predetermined condition is satisfied.

23. The sheet processing method according to claim 22, wherein the predetermined condition is a condition related to a temperature change of at least one of the fixing member and the pressurizing member, and is at least one condition among a condition indicating whether a number of printed sheets is equal to or greater than a predetermined number of sheets, a condition indicating whether a printing time exceeds a predetermined time, and a condition indicating whether at least one of a temperature of the fixing member and a temperature of the pressurizing member exceeds a predetermined temperature.

* * * * *